US011946712B2

(12) United States Patent
Wiseman et al.

(10) Patent No.: US 11,946,712 B2
(45) **Date of Patent: *Apr. 2, 2024**

(54) ELECTROMAGNETIC PISTOL BARREL TEST FIXTURE

(71) Applicant: Bill Wiseman & Co., Inc., College Station, TX (US)

(72) Inventors: William Wiseman, College Station, TX (US); Levi Munoz, Navasota, TX (US); James Darley, Magnolia, TX (US)

(73) Assignee: Bill Wiseman & Co., Inc., College Station, TX (US)

( * ) Notice: Subject to any disclaimer, the term of this patent is extended or adjusted under 35 U.S.C. 154(b) by 771 days.

This patent is subject to a terminal disclaimer.

(21) Appl. No.: 17/077,069

(22) Filed: Oct. 22, 2020

(65) Prior Publication Data

US 2021/0116202 A1 Apr. 22, 2021

Related U.S. Application Data

(60) Provisional application No. 62/924,480, filed on Oct. 22, 2019.

(51) Int. Cl.
*F41A 23/16* (2006.01)
*F41A 19/08* (2006.01)
*F41A 31/02* (2006.01)

(52) U.S. Cl.
CPC ..... *F41A 23/16* (2013.01); *F41A 19/08* (2013.01); *F41A 31/02* (2013.01)

(58) Field of Classification Search
CPC ..... F41A 31/00; F41A 23/16; F41A 19/01; F41A 21/32; F41A 23/18; F41A 33/00; F41A 23/10; F41A 23/14; F41A 33/06; F41A 31/02; F41A 25/10; F41A 29/00; F41A 33/02; F41A 21/325; F41A 17/14; F41A 17/54; F41A 19/00; F41A 19/03; F41A 19/10; F41A 19/42; F41A 19/58; F41A 19/64; F41A 19/70; F41A 21/30; F41A 21/40; F41A 23/00; F41A 23/005; F41A 23/02; F41A 23/08; F41A 27/10; F41A 3/22; F41A 3/74; F41A 9/53; F41A 23/06
USPC ..... 73/167
See application file for complete search history.

(56) References Cited

U.S. PATENT DOCUMENTS

| | | | | |
|---|---|---|---|---|
| 7,555,930 | B2 * | 7/2009 | Lim | G01N 3/303 73/12.06 |
| 10,240,881 | B1 * | 3/2019 | Galie | F41A 19/59 |
| 2021/0222985 | A1 * | 7/2021 | Wiseman | F41A 31/00 |

FOREIGN PATENT DOCUMENTS

| | | | | |
|---|---|---|---|---|
| CN | 212567861 | U * | 2/2021 | |
| CN | 114719673 | B * | 3/2023 | |
| EP | 2290314 | A2 * | 3/2011 | F41A 23/16 |

* cited by examiner

*Primary Examiner* — Andre J Allen
(74) *Attorney, Agent, or Firm* — Harness, Dickey & Pierce, P.L.C.

(57) ABSTRACT

A test fixture for testing firearms or ammunition includes a base, a block, and a firing pin. The base has a lateral channel defining a front upright and a rear upright. The front upright is configured to support a firearm barrel. The block is rotatable within the lateral channel between an open position and a closed position. The open position provides user access to the firearm barrel. The firing pin is housed in the block. The closed position of the block aligns the firing pin with the firearm barrel.

17 Claims, 6 Drawing Sheets

ELECTROMAGNETIC PISTOL BARREL TEST FIXTURE

CROSS-REFERENCE TO RELATED APPLICATIONS

This application claims the benefit of U.S. Provisional Application No. 62/924,480, filed on Oct. 22, 2019. The entire disclosure of the above application is incorporated herein by reference.

FIELD

The present disclosure relates to firearms test fixtures, and, more specifically, an electromagnetic pistol barrel test fixture.

BACKGROUND

This section provides background information related to the present disclosure which is not necessarily prior art.

Companies or entities purchasing firearms and/or ammunition often test the product before purchase or benchmark the product against other related products. Test fixtures may assist in testing these products.

SUMMARY

This section provides a general summary of the disclosure, and is not a comprehensive disclosure of its full scope or all of its features.

A test fixture for testing firearms or ammunition according to the present disclosure may include a base, a block, and a firing pin. The base may have a lateral channel defining a front upright and a rear upright. The front upright may be configured to support a firearm barrel. The block may be rotatable within the lateral channel. The block may be rotatable between an open position and a closed position. The open position may provide user access to the firearm barrel. The firing pin may be housed in the block. The closed position of the block may align the firing pin with the firearm barrel.

In an example embodiment, the test fixture may include an actuation assembly configured to fire a projectile loaded in the firearm barrel.

In an example embodiment, the actuation assembly may include a magnet.

In an example embodiment, the magnet may be activated by supplying power to the magnet, and the power may be supplied to the magnet by pressing a remote button to complete a circuit between a power supply and the magnet.

In an example embodiment, the actuation assembly may be fixed to the rear upright of the base.

In an example embodiment, the actuation assembly may include a coil, an end plate, and a rod projecting from the end plate into the base.

In an example embodiment, the rod may project into the rear upright of the base.

In an example embodiment, when the actuation assembly fires the projectile, the rod may move within the rear upright to contact the firing pin and press the firing pin into the projectile.

In an example embodiment, the front upright may include a channel extending orthogonal to the lateral channel. The channel in the front upright may receive a bottom insert that cooperates with a top insert to clamp the firearm barrel.

In an example embodiment, an insert holder may cooperate with the front upright to clamp the top insert, bottom insert, and firearm barrel. The insert holder may include a channel mirroring the channel in the front upright, and the channel in the insert holder may receive the top insert. The insert holder and front upright may fix a position of the barrel relative to the base.

In an example embodiment, the firing pin may be part of a firing pin assembly disposed in a bore in the block. The firing pin assembly may include a front support and a rear support positioning the firing pin within the block.

In another example embodiment, a test fixture for testing firearms or ammunition according to the present disclosure may include a base and an actuation assembly. The base may be configured to support a firearm barrel. The actuation assembly may be configured to fire a projectile loaded in the firearm barrel. The actuation assembly may include a coil, an end plate, and a rod projecting from the end plate into the base. When power is supplied to the coil, the coil may become a magnet and the end plate may move from a position separated from the coil to a position contacting the coil.

In an example embodiment, a method of testing firearms or ammunition according to the present disclosure may include fixing a firearm barrel to a test fixture; loading a projectile into the firearm barrel; supplying power to an actuation assembly on the test fixture to activate a magnet; and pushing a firing pin in the test fixture into the projectile.

In an example embodiment, the fixing the firearm barrel to the test fixture may include clamping the firearm barrel between a first insert and a second insert, and clamping the first insert, the second insert, and the firearm barrel between an insert holder and a base of the test fixture.

In an example embodiment, the supplying power to the actuation assembly may include remotely pressing a button to complete a circuit between a power supply and the actuation assembly.

In an example embodiment, the pushing the firing pin into the projectile may include moving an end plate of the actuation assembly from a first position spaced from a coil to a second position contacting the coil when the magnet is activated, and moving a rod projecting from the end plate within a base of the fixture to contact the firing pin and push the firing pin into the projectile.

In an example embodiment, the loading the projectile into the firearm barrel may include rotating a door of the test fixture to an open position, exposing a rear-facing end of the firearm barrel, loading a projectile into the rear-facing end of the firearm barrel, and rotating a door of the test fixture to a closed position, aligning the firing pin with the projectile.

In an example embodiment, the method may include loading the firing pin into the door of the fixture.

In an example embodiment, the loading of the firing pin into the door of the fixture may include loading a rear support into a bore in the door, loading the firing pin into the rear support, and loading a front support onto the firing pin and into the bore in the door.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
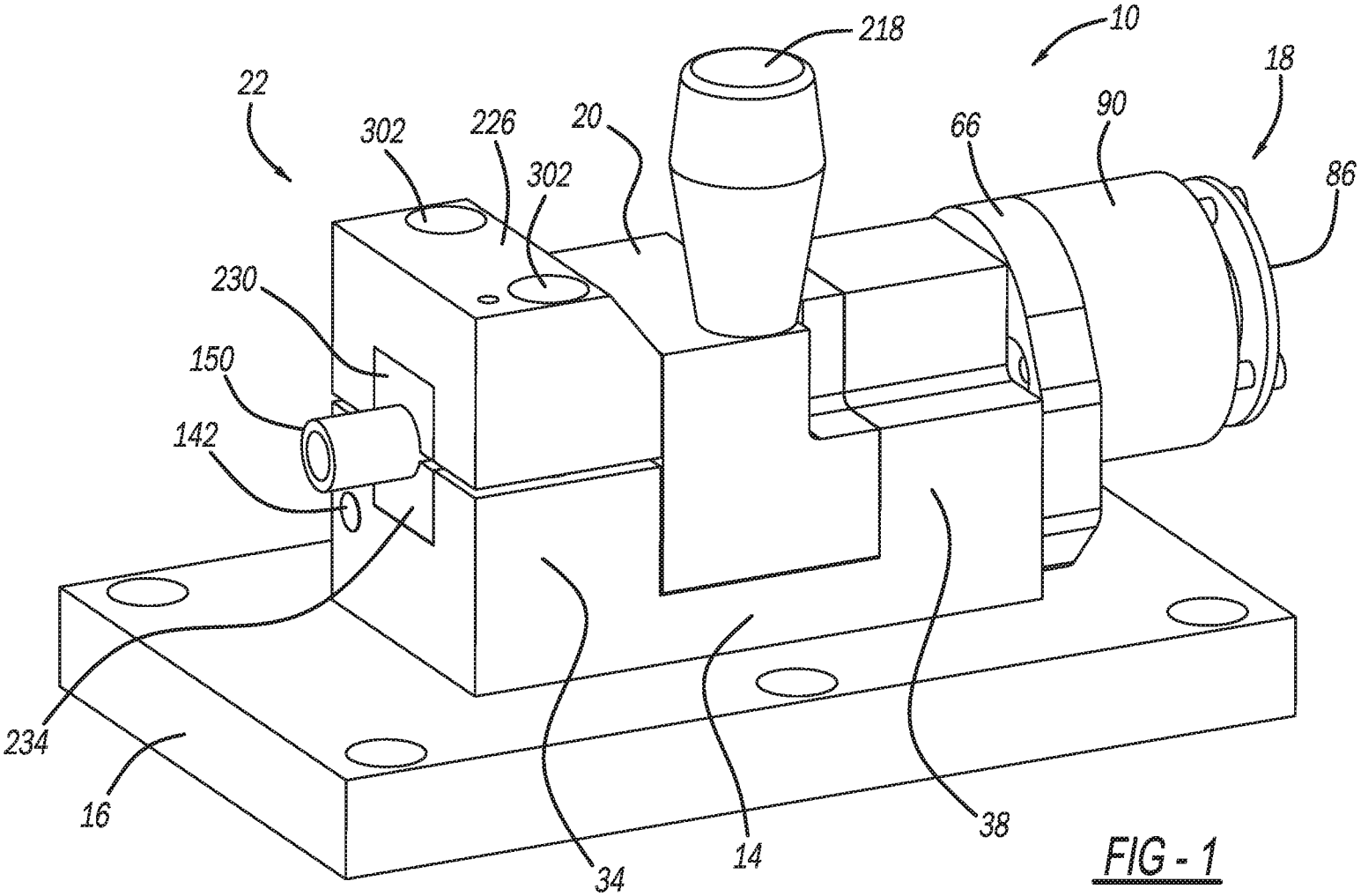
FIG. 1 is a front perspective view of an example embodiment of a test fixture according to the present disclosure.
Figure 2:
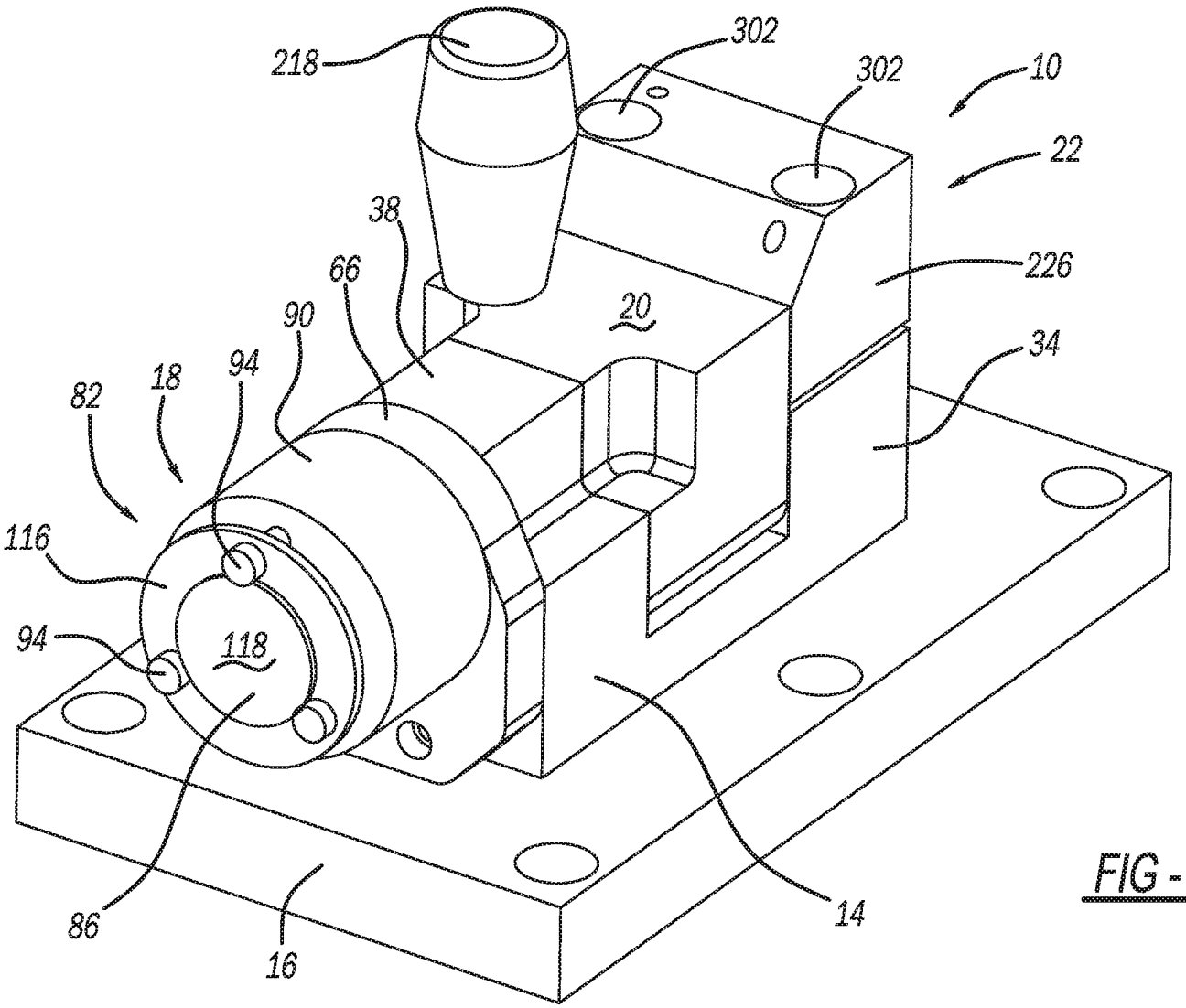
FIG. 2 is a rear perspective view of the test fixture in FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosure relates to a pistol barrel test fixture that was designed and developed for use by manufacturers or purchasers (such as private entities or the government) when experimenting or benchmarking various suppliers of ammunition and/or various barrel designs. The design of the pistol barrel test fixture removes human variances and allows the tester or user to determine a true accuracy of the barrel or ammunition being tested.

A unique advantage of the pistol barrel test fixture of the present disclosure is that the fixture is able to test a variety of pistol barrels by swapping out interchangeable inserts manufactured to hold an exterior of the pistol barrel. As such, different pistol barrels, held by interchangeable inserts, may be tested using a single pistol barrel test fixture.

Additionally, the pistol barrel test fixture of the present disclosure is operated by pushing a button only requiring a power source from any standard 110 volt AC outlet. The push button actuation feature enables the pistol barrel test fixture to be fired from a safe distance.

Now referring to FIG. 1, an example embodiment of a pistol barrel test fixture 10 is illustrated. The fixture 10 includes a base 14 fixed to a platform 16, an actuation assembly 18, a block 20, and a barrel retention assembly 22. A front face 24 of the base 14 faces a downrange direction and a rear face 26 of the base faces a direction opposite the front face 24. In an example embodiment, the base 14 may be fixed to the platform 16 by a plurality of fasteners or other fixing mechanism.

Figure 5:
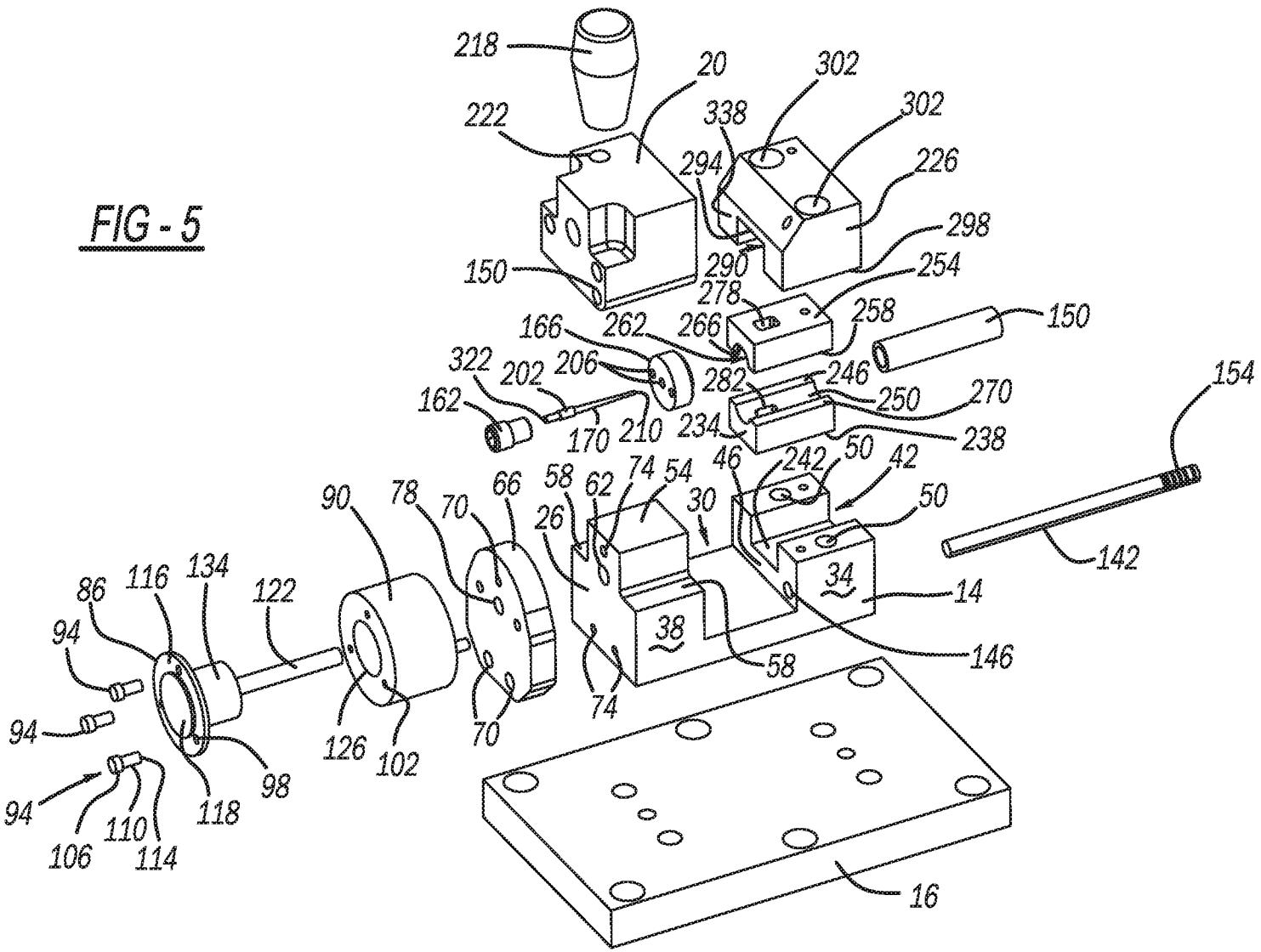
FIG. 5 is an exploded view of the test fixture in FIG. 1.
Figure 6:
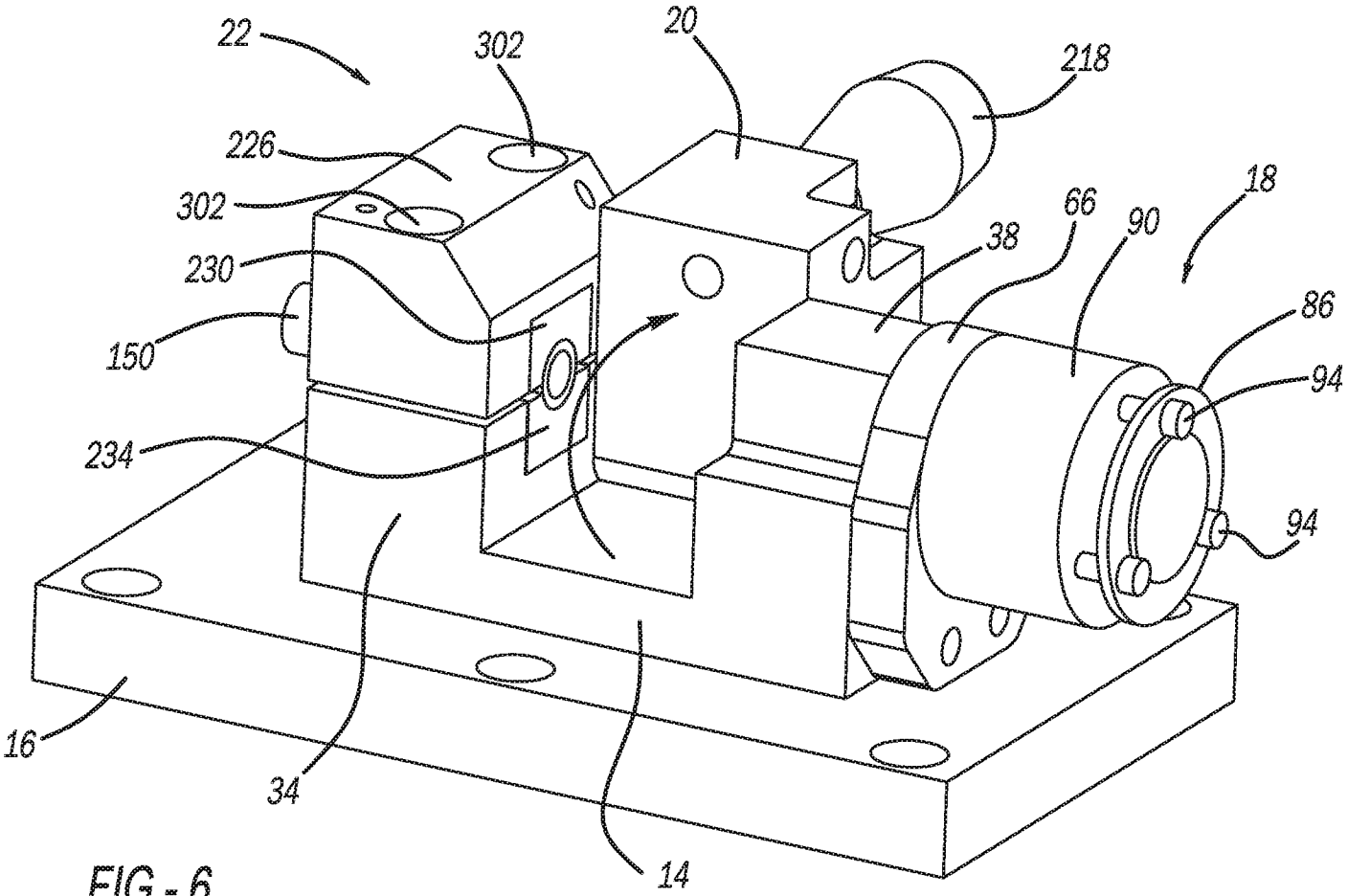
FIG. 6 is a perspective view of the test fixture in FIG. 1 with the block in an open position.

Additionally referring to FIG. 5, in an example embodiment, the base 14 may be a U-shaped base with a channel 30 extending laterally therethrough and bisecting the base 14. The channel 30 may define a front upright 34 and a rear upright 38. The front face 24 may be on the downrange end of the front upright 34, and the rear face 26 may be on an opposite end of the rear upright 38.

In an example embodiment, the front upright 34 may include a longitudinal channel 42 extending perpendicular to the lateral channel 30 in the base 14. A depth of the longitudinal channel 42 may be less than a depth of the lateral channel 30 such that a step 46 exists between the longitudinal channel 42 and the lateral channel 30. A plurality of apertures 50 may extend through the thickness (i.e., in a Z-direction) of the front upright 34 on opposing sides of the longitudinal channel 42. The plurality of apertures 50 may receive fasteners for fastening the base 14 to the platform 16.

In an example embodiment, the rear upright 38 may include a longitudinally extending projection 54 extending perpendicular to the lateral channel 30 in the base 14 and aligned with the longitudinal channel 42 in the front upright 34. The projection 54 may define stepped shoulders 58 on opposing sides of the projection 54. A longitudinal bore 62 may extend through the projection 54. The longitudinal bore 62 may be parallel to, and axially aligned with the longitudinal channel 42 in the front upright 34.

In an example embodiment, a spacer 66 may separate the actuation assembly 18 from the base 14. The spacer 66 may abut the rear face 26 of the base 14 and may be fixed to the rear face 26 of the base 14 by fasteners (not shown). The fasteners (not shown) may be received in longitudinal apertures 70 that align with longitudinal apertures 74 in the rear upright 38 of the base 14. A longitudinal bore 78 extending through a thickness of the spacer 66 may align with the longitudinal bore 62 in the rear upright 38 of the base 14.

In an example embodiment, the spacer 66 may have a circular, oval, hexagonal, octagonal, or other shape. In an example embodiment, the spacer 66 may have a depth within a range of 0.5-4.0 inches (in.), and more specifically, of about 2.555 in. (plus or minus 0.010 in. tolerance), to space the magnet 82 about 2.555 in. from the rear face 26 of the base 14.

Figure 3:
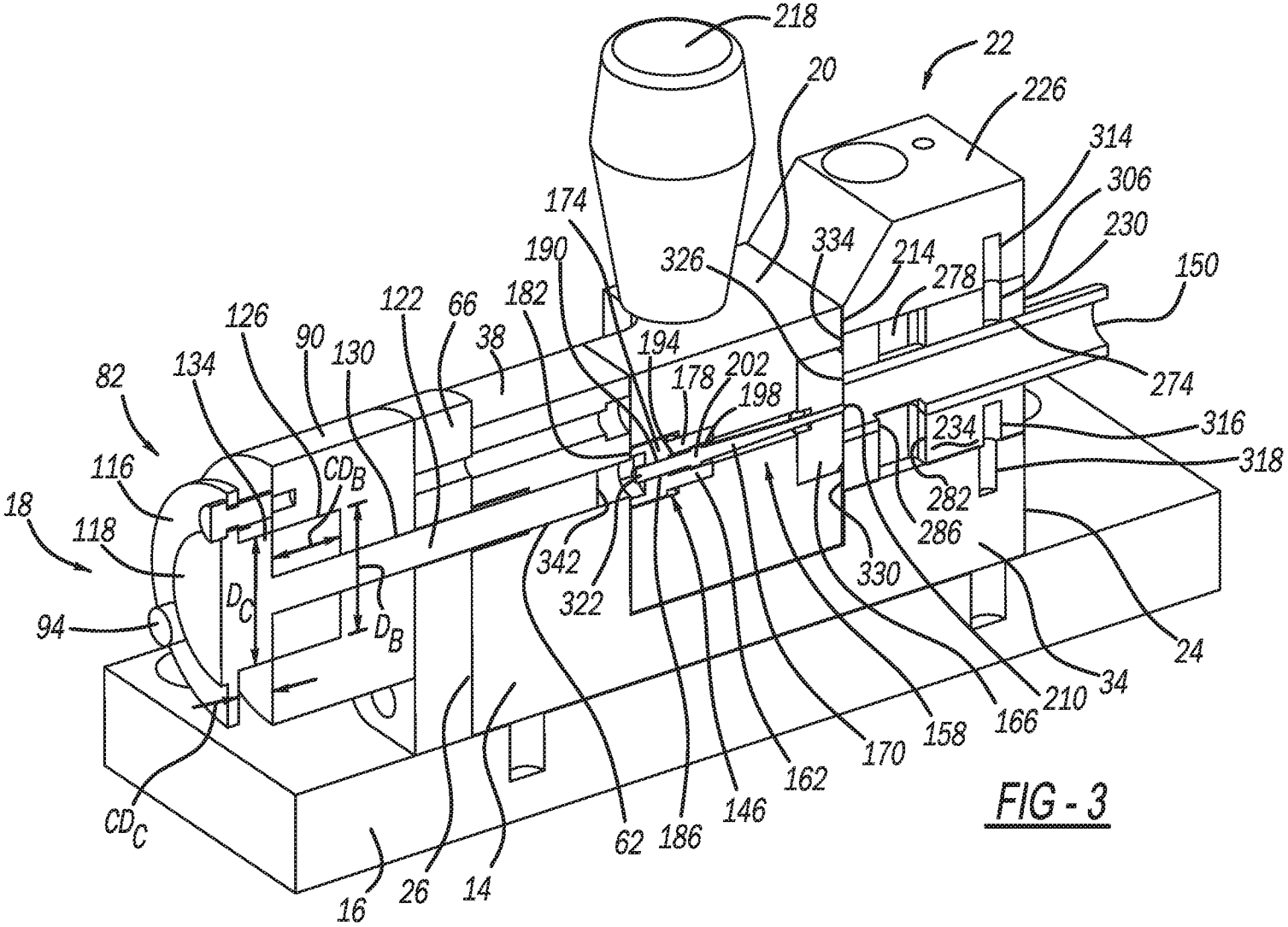
FIG. 3 is a cross-sectional view of the test fixture in FIG. 2 taken along line 3-3.
Figure 4:
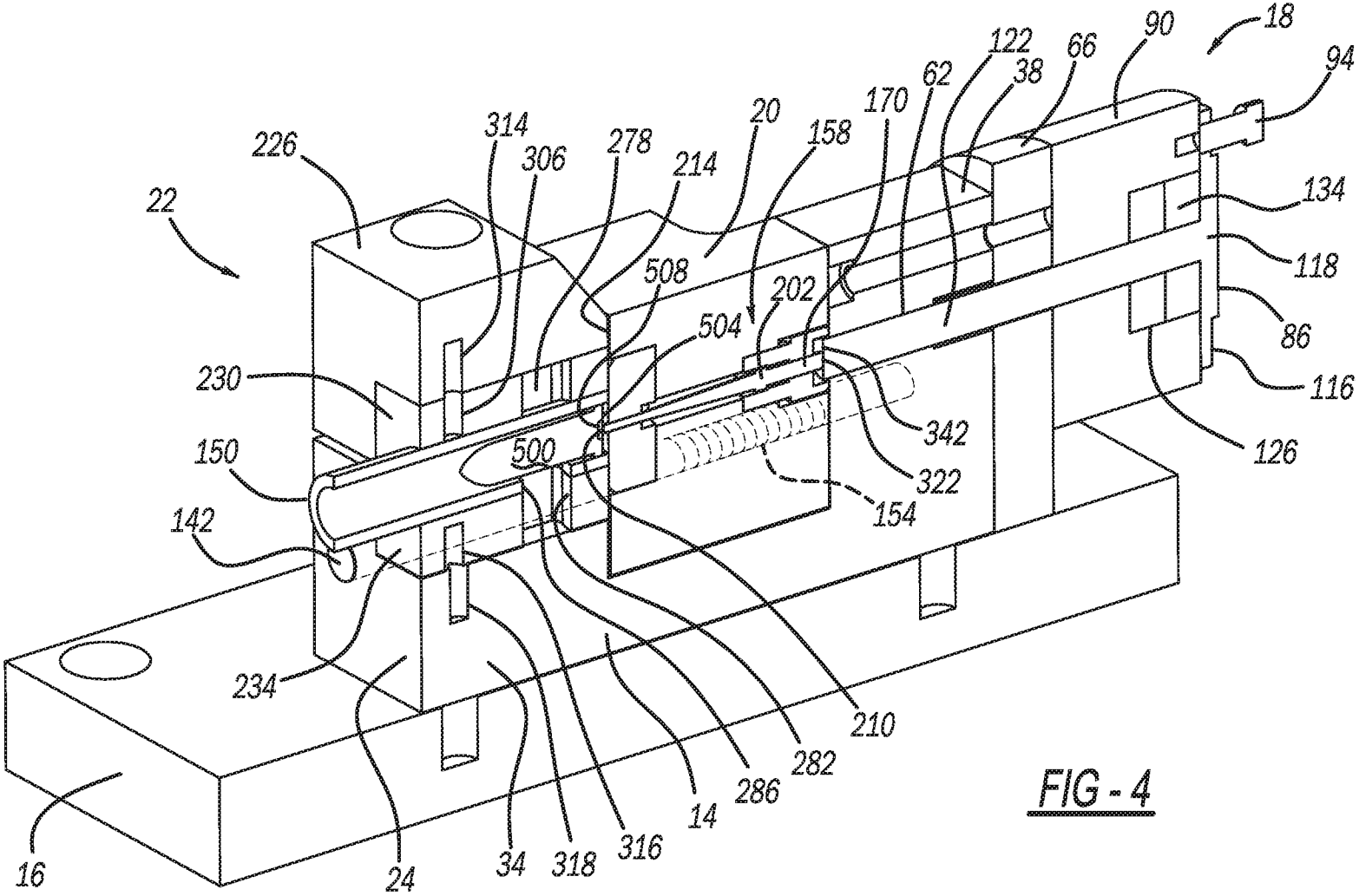
FIG. 4 is another cross-sectional view of the test fixture in FIG. 2 taken along line 3-3.

Referring to FIG. 3, in an example embodiment, the actuation assembly 18 may include a magnet 82 having an end plate 86 and a coil 90. The end plate 86 may be attached to the coil 90 by biasing members 94. For example, biasing members 94 may be springs, such as helical or wave springs. In an example embodiment, biasing members 94 may be received within apertures 98 in end plate 86 and apertures 102 in coil 90. The biasing members 94 may each include a head 106 and a shaft 110. A diameter of the head 106 may be larger than the shaft 110 and the aperture 98 such that the shaft 110 extends through the aperture 98 but the head 106 does not. The head 106, instead retains the end plate 86 on the shaft 110. The shaft 110 of the biasing member 94 engages the aperture 102 in coil 90 on a free end 114. The biasing members 94 may bias the end plate 86 away from the coil 90. When the coil 90 is energized, the end plate 86 overcomes the biasing force and contacts the coil 90.

In an example embodiment, the end plate 86 may include an outer ring 116 that receives the biasing members 94 and a central core 118 having an interior rod 122 projecting therefrom. The interior rod 122 may extend through a bore 126 and an aperture 130 in the coil 90. The interior rod 122 may further extend into and be slideable within the longitudinal bore 62 in the base 14.

In an example embodiment, the bore 126 may be a countersunk bore having a countersink depth $CD_B$ equal to a depth $CD_C$ of a large diameter portion 134 of the central core 118. In another example embodiment, the countersink depth $CD_B$ of the bore 126 may be within a range of 0.5 to 1.5 in., and more specifically about 1.030 in. (plus or minus 0.010 in. tolerance) larger than the depth $CD_C$ of the large diameter portion 134 of the central core 118.

In an example embodiment, a diameter $D_B$ of the bore 126 may be slightly larger than a diameter $D_C$ of the large diameter portion 134 of the core 118. More particularly, for example, the diameter $D_B$ of the bore 126 may be about 0.06 in. larger than the diameter $D_C$ of the core 118. For example only, the diameter $D_B$ of the bore 126 may be about 1.360 in. (plus or minus 0.010 in. tolerance), and the diameter $D_C$ of the core 118 may be about 1.300 in. (plus or minus 0.010 in. tolerance).

Now referring to FIGS. 3-6, in an example embodiment, the channel 30 in the base 14 may receive the block 20 rotatably attached thereto by a rotation rod, or pivot rod, 142. Rotation rod 142 may be fixed within apertures 146 extending longitudinally through the base 14 and may be slideably positioned within an aperture 146 in the block 20. The block 20 may pivot relative to the rotation rod 142 to move between an open position and a closed position. In an example embodiment, in the open position, a longitudinal aperture 146 in the block 20 is misaligned with the longitudinal bore 62 in the base 14 and a user has access to a barrel 150. In the closed position, the longitudinal aperture 146 in the block 20 is aligned with the longitudinal bore 62 in the base 14 and the block 20 blocks access to the barrel 150. In an example embodiment, a biasing member (for example, a helical spring) 154 may be disposed on the rotation rod 142 at the block 20 to bias the block 20 in the closed position.

In an example embodiment, the block 20 may support and position a firing pin assembly 158 within the longitudinal aperture 146. The firing pin assembly 158 may include a rear support, or insert, 162, a front support, or insert, 166, and a firing pin 170. The rear support 162 and front support 166 may be positioned on opposing ends of the firing pin 170 and may cooperate to align and position the firing pin within the longitudinal aperture 146 in the block 20.

In an example embodiment, the rear support 162 may be a cylindrical, or tubular, support having a large diameter portion 174 and a small diameter portion 178. The large diameter portion 174 may be countersunk on a free end 182 and includes a bore 186 having a first inner diameter portion 190. The first inner diameter portion 190 includes a diameter that may be equal to or slightly larger than a diameter of the firing pin 170, such that when the firing pin 170 is inserted in the bore 186, the firing pin 170 is fixed relative to the large diameter portion 174 and protrudes into the countersunk free end 182.

In an example embodiment, the small diameter portion 178 includes the bore 186 having a second inner diameter portion 194 and a third inner diameter portion 198. The second inner diameter portion 194 may be slightly smaller than the third inner diameter portion 198 such that when the firing pin 170 is inserted in the bore 186, a circumferential ridge 202 on the firing pin 170 is slideable within the third inner diameter portion 198 but too large to fit within the second inner diameter portion 194. Thus, the second inner diameter portion 194 may act as a stop for the firing pin 170, preventing further insertion into the bore 186.

In an example embodiment, the rear support 162 may be slideable within the longitudinal aperture 146. For example, the longitudinal aperture 146 may be countersunk on an end receiving the rear support 162, with the countersink depth being slightly larger than a length of the large diameter portion 174. For example only, the countersink depth may be within a range of about 0.05-0.2 in. (plus or minus 0.010 in. tolerance) larger than a length of the large diameter portion 174 to allow longitudinal movement of the rear support 162. In an example embodiment, the countersink depth may be about 0.525 (plus or minus 0.010 tolerance).

In an example embodiment, the front support 166 may be a cylindrical support having a plurality of apertures 206 through a thickness thereof. When assembled, a striking end 210 of the firing pin 170 may be inserted through one of the plurality of apertures 206 (for example the center aperture)

to align the firing pin 170 with a center of the barrel 150. The front support 166 may be disposed in an opposing end 214 of the longitudinal aperture 146 from the rear support 162. The opposing end 214 may be countersunk to receive the front support 166 therein.

Use of the front support 166 and rear support 162 provide interchangeability for firing pins. Thus, a variety of different firing pins may be used and tested in the fixture 10 by simply swapping firing pins 170, front supports 166, and rear supports 162 (if necessary).

In an example embodiment, a handle 218 may be engaged with the block 20 to move the block 20 from the closed position to the open position and/or from the open position to the closed position. The handle 218 may be threadably received within an aperture 222 in the block 20 to fix the handle 218 to the block 20. In other examples, the handle 218 may be welded, or otherwise fixed to the block 20.

In an example embodiment, the barrel retention assembly 22 may fix a position of the barrel 150 relative to the base 14. The barrel retention assembly 22 may include an insert holder 226 that cooperates with the front upright 34 of the base 14 to support and removably fix a top insert 230 and a bottom insert 234 to the base 14. The top insert 230 and the bottom insert 234 may support and position the barrel 150 relative to the base 14.

In an example embodiment, the bottom insert 234 may include a flat, planar, bottom surface 238 that mates with a surface 242 of the longitudinal channel 42 of the front upright 34. The bottom insert 234 may also include a top surface 246 having a channel 250 therein. The channel 250 may extend longitudinally along the top surface 246 along an axis through the length of the bottom insert 234. In an example embodiment, the channel 250 may include a semicircular cross-section that mates with an exterior shape of the barrel 150.

In an example embodiment, the top insert 230 may include a flat, planar, top surface 254 and a bottom surface 258 having a channel 262 therein. The channel 262 may extend longitudinally along the bottom surface 258 along an axis through the length of the top insert 230. In an example embodiment, the channel 262 may include a semicircular cross-section that mates with an exterior shape of the barrel 150.

The channel 262 may define outer edges 266 in the bottom surface 258 of the top insert 230, and the channel 250 may define outer edges 270 in the top surface 246 of the bottom insert 234. In an example embodiment, the outer edges 266 in the bottom surface 258 of the top insert 230 may mate with the outer edges 270 in the top surface 246 of the bottom insert 234. When assembled, the channel 250 in the bottom insert 234 may align with the channel 262 in the top insert 230 to create a bore, or aperture, 274 for receiving the barrel 150.

In an example embodiment, the top insert 230 and the bottom insert 234 may include rectangular apertures 278, 282, respectively, that align with a rectangular aperture 286 in the barrel 150. The rectangular aperture 278 may extend from the top surface 254 of the top inset 230 through the channel 262. The rectangular aperture 282 may extend from the bottom surface 238 of the bottom insert 234 through the channel 250. In use, the rectangular apertures 278, 282 may help stabilize the barrel 150 and hold the barrel 150 in place relative to the inserts 230, 234. While the example embodiment is illustrated as having rectangular apertures 278, 282 in the inserts 230, 234 and aperture 286 in the barrel 150, it is noted that each interchangeable insert will vary in design, and some inserts may not have the rectangular aperture feature. The design of the inserts 230, 234 depend on the exterior design of the barrel 150 that is being tested. Thus, the design of the inserts 230, 234 will be formed to mirror the exterior design of the barrel 150.

In an example embodiment, the insert holder 226 may include a longitudinal channel 290 having a surface 294 that mates with the top surface 254 of the top insert 230. For example, the longitudinal channel 290 may mirror the longitudinal channel 42 in the front upright 34 in the base 14. A depth of the longitudinal channel 290 may be formed such that the top insert 230 fits within the longitudinal channel 290 and the outer edge 266 of the top insert 230 is flush with an outer edge 298 of the insert holder 226.

In an example embodiment, the insert holder 226 may include vertical apertures 302 that align with apertures 50 in the front upright 34 of the base 14. The vertical apertures 302 and apertures 50 may receive fasteners to clamp the insert holder 226 to the base 14 (and, thus clamp the barrel 150 in the inserts 230, 234.

In an example embodiment, the top insert 230 and the bottom insert 234 may include cylindrical apertures 306, 310, respectively, that align with apertures 314, 318 in the insert holder 226 and front upright 34, respectively. The apertures 306, 310, 314, 318 may receive pins (not shown) to position the top insert 230 and the bottom insert 234 in the channels 290, 42, respectively.

In an example embodiment, the various pieces and parts of the fixture 10 are manufactured from a metal, such as, tool steel, alloy steel, other steel, or other compatible materials (for example only, 01 Tool Steel, 8620 Alloy Steel, etc.).

During operation, the firing pin assembly 158 is loaded into the block 20 of the fixture 10. The firing pin 170 is assembled into the rear support 162. A rearward-facing end 322 of the firing pin 170 is inserted into the third inner diameter portion 198, second inner diameter portion 194, and first inner diameter portion 190 of the bore 186 in the rear support 162. The rearward-facing end 322 of the firing pin 170 is inserted into the first inner diameter portion 190 until the ridge 202 of the firing pin 170 contacts the second inner diameter portion 194 which acts as a stop to properly place the firing pin 170 in the rear support 162.

In an example embodiment, the firing pin 170 and rear support 162 are placed in longitudinal aperture 146 such that the rear support 162 aligns in the countersunk end of the longitudinal aperture 146 matching the shape of the rear support 162. Once the firing pin 170 is inserted through the longitudinal aperture 146, one of the plurality of apertures 206 (for example, the center aperture) of the front support 166 is aligned with the striking end 210 of the firing pin 170. The striking end 210 of the firing pin 170 is inserted through the aperture 206 in the front support 166, and the front support 166 is inserted into the countersunk portion on the opposing end 214 of the longitudinal aperture 146.

In an example embodiment, the barrel 150 is loaded into the fixture 10. For example, the barrel 150 is placed in the channel 250 of the bottom insert 234 with a rearward end 326 of the barrel 150 aligning flush with a rear face 330 of the bottom insert 234. The top insert 230 is aligned with the barrel 150 such that the barrel 150 fits within the channel 262 and a rear face 334 of the top insert 230 aligns flush with the rearward end 326 of the barrel 150 and the rear face 330 of the bottom insert 234.

The outer edges 266 of the top insert 230 are brought into engagement with the outer edges 270 of the bottom insert 234 to sandwich the barrel 150 within the bore 274 defined by channels 250 and 262. In an example embodiment, the rectangular aperture 286 in the barrel 150 aligns with at least one of the rectangular apertures 278, 282 in the top insert 230 and bottom insert 234, respectively.

The top insert 230, bottom insert 234, and barrel 150 assembly is aligned on the front upright 34 of the base 14. In some embodiments, the bottom insert 234 fits within longitudinal channel 42 in the front upright 34. When assembled, the rear face 334 of the top insert 230, the rear face 330 of the bottom insert 234, and the rearward end 326 of the barrel 150 may be aligned flush with the step 46 in the front upright. In an example embodiment, a guide pin (not shown) in the aperture 318 in the front upright 34 is inserted in the aperture 310 in the bottom insert 234 to properly position and align the top insert 230, bottom insert 234, and barrel 150 assembly on the front upright 34.

The insert holder 226 is aligned on the top insert 230. In some embodiments, the top insert 230 fits within longitudinal channel 290 in the insert holder 226. When assembled, the rear face 334 of the top insert 230, the rear face 330 of the bottom insert 234, and the rearward end 326 of the barrel 150 may be aligned flush with the step 46 in the front upright and a rear face 338 in the insert holder 226. In an example embodiment, a guide pin (not shown) in the aperture 306 in the top insert 230 is inserted in the aperture 314 in the insert holder 226 to properly position and align the insert holder 226 with the top insert 230, bottom insert 234, and barrel 150 assembly on the front upright 34.

A plurality of fasteners (not shown) may be inserted through apertures 302 in insert holder 226 and apertures 50 in front upright 34 to secure the insert holder 226 to the base 14 and sandwich and fix the top insert 230, bottom insert 234, and barrel 150 assembly to the base 14.

To load ammunition or a projectile 500 into the barrel 150, a user applies force to the handle 218 to rotate the block 20 from the closed position to an open position. In an example embodiment, the block 20 pivots about the rotation rod 142 to rotate from the closed position to the open position. When the block 20 is in the open position, the user can access the barrel 150 at the rearward end 326 thereof. The projectile 500 may be inserted into the rearward end 326 of the barrel 150 such that a rear face 504 of the projectile 500 aligns with the rearward end 326 of the barrel 150.

In an example embodiment, the user or the biasing member 154 (for example, helical spring) may return the block 20 to the closed position. In the closed position, the striking end 210 of the firing pin 170 aligns with a primer 508 (or a center) on the rear face 504 of the projectile 500. Additionally, in the closed position, the rearward facing end 322 of the firing pin 170 aligns with a center of the longitudinal bore 62 in the rear upright 38.

Power may be supplied to the magnet 82 of the actuation assembly 18 by wiring (not shown). As previously mentioned, the wiring may be connected to a power supply (for example, any standard 110 volt AC source, or any other power source). An opposing end of the wiring may be connected to the coil 90 of the magnet 82. Upon actuation, power may be supplied from the source to the coil 90 to create a magnetic field. In an example embodiment, the user may actuate the magnet by pushing a button completing the circuit from the power supply to the coil 90. Accordingly, the actuation assembly 18 may provide the user with the ability to remotely actuate the actuation assembly 18.

When the coil 90 is energized, the coil 90 becomes a magnet, attracting the outer ring 116 of the end plate 86. The outer ring 116 of the end plate 86 overcomes biasing members 94 and is brought into contact with the coil 90. Central core 118 moves from an unactuated position away from the bore 126 into an actuated position within the bore 126. As central core 118 moves toward the front face 24, the rod 122 projecting from the core 118 moves toward the firing pin 170.

A front face 342 of the rod 122 contacts the rearward facing end 322 of the firing pin 170 as the front face 342 of the rod 122 passes from the longitudinal bore 62 in the rear upright 38 into the countersunk large diameter portion 174 of the rear support 162. When the front face 342 of the rod 122 contacts the rearward facing end 322 of the firing pin 170, the firing pin 170 is projected forward.

When the firing pin 170 is projected forward, the striking end 210 of the firing pin 170 slides through the aperture 206 in the front support 166 and into the barrel 150. When the striking end 210 of the firing pin 170 crosses into the barrel 150, the striking end 210 contacts the primer 508 of the projectile 500.

When the striking end 210 of the firing pin 170 contacts the primer 508 of the projectile 500, a small explosive charge in the primer 508 is ignited. The primer 508 ignites the propellant in the projectile 500, the main explosive that may occupy up to ⅔ of the cartridge in the projectile 500. When the propellant burns, a large amount of gas is generated very quickly. The sudden, high pressure of the gas splits a bullet from the end of the cartridge, forcing it down the barrel 150 at extremely high speed (for example, at about 300 m/s depending on the amount of propellant and type of projectile).

While a centerfire projectile 500 is illustrated and described, it is understood that the projectile may also be a rimfire projectile. In an example embodiment where the projectile 500 is a rimfire projectile, the firing pin 170 strikes and crushes a rim of the base of the projectile 500 to ignite the primer. Like the centerfire example, the primer ignites the propellant in the projectile 500. When the propellant burns, a large amount of gas is generated very quickly. The sudden, high pressure of the gas splits a bullet from the end of the cartridge, forcing it down the barrel 150 at extremely high speed.

After the projectile 500 is fired, the circuit in the wiring connecting the power source with the coil 90 is broken, interrupting the flow of current. The coil 90 no longer attracts the end plate 86 and the end plate 86, core 118, and rod 122 return to the original position.

In an example embodiment, a return spring (not pictured; for example, a 2 lb. spring) within the longitudinal aperture 146 returns the firing pin 170 back to the original position. The return spring may bias the firing pin 170 rearward, such that the ridge 202 contacts the second inner diameter portion 194. When the coil 90 attracts the end plate 86, pushing the rod 122 into the firing pin 170, as earlier discussed, the force from the rod 122 overcomes the biasing force from the return spring and projects the firing pin 170 into the projectile 500. When the power source is disconnected with the coil 90 (i.e., without the magnetic force from the coil 90 attracting the end plate 86) there is no force to overcome the biasing force of the return spring, and the firing pin 170 is returned to its original position.

The user applies force to the handle 218 to rotate the block 20 from the closed position to an open position. In an example embodiment, the block 20 pivots about the rotation rod 142 to rotate from the closed position to the open position. When the block 20 is in the open position, the user can access the barrel 150 at the rearward end 326 thereof. The remainder of the projectile 500 (for example, the cartridge) may be removed from the rearward end 326 of the barrel 150. The user may optionally reload the barrel 150 with a new projectile 500. In an example embodiment, the user or the biasing member 154 (for example, helical spring) may return the block 20 to the closed position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A test fixture for testing firearms or ammunition, the test fixture comprising:

a base having a lateral channel defining a front upright and a rear upright, the front upright being configured to support a firearm barrel;

a block rotatable within the lateral channel, the block being rotatable between an open position and a closed position, the open position providing user access to the firearm barrel; and a firing pin housed in the block, the closed position of the block aligning the firing pin with the firearm barrel.

2. The test fixture of claim 1, further comprising:

an actuation assembly configured to fire a projectile loaded in the firearm barrel.

3. The test fixture of claim 2, wherein the actuation assembly includes a magnet.

4. The test fixture of claim 3, wherein the magnet is activated by supplying power to the magnet, and the power is supplied to the magnet by pressing a remote button to complete a circuit between a power supply and the magnet.

5. The test fixture of claim 2, wherein the actuation assembly is fixed to the rear upright of the base.

6. The test fixture of claim 2, wherein the actuation assembly includes a coil, an end plate, and a rod projecting from the end plate into the base.

7. The test fixture of claim 6, wherein the rod projects into the rear upright of the base.

8. The test fixture of claim 7, wherein when the actuation assembly fires the projectile, the rod moves within the rear upright to contact the firing pin and press the firing pin into the projectile.

9. The test fixture of claim 1, wherein the front upright includes a channel extending orthogonal to the lateral channel, the channel in the front upright receiving a bottom insert that cooperates with a top insert to clamp the firearm barrel.

10. The test fixture of claim 9, wherein an insert holder cooperates with the front upright to clamp the top insert, the bottom insert, and the firearm barrel, the insert holder including a channel mirroring the channel in the front upright, the channel in the insert holder receiving the top insert, and the insert holder and the front upright fixing a position of the firearm barrel relative to the base.

11. The test fixture of claim 1, wherein the firing pin is part of a firing pin assembly disposed in a bore in the block, the firing pin assembly including a front support and a rear support positioning the firing pin within the block.

12. A method of testing firearms or ammunition, the method comprising:

fixing a firearm barrel to a test fixture;

loading a projectile into the firearm barrel;

supplying power to an actuation assembly on the test fixture to activate a magnet; and pushing a firing pin in the test fixture into the projectile, wherein the pushing the firing pin into the projectile includes moving an end plate of the actuation assembly from a first position spaced from a coil to a second position contacting the coil when the magnet is activated, and moving a rod projecting from the end plate within a base of the test fixture to contact the firing pin and push the firing pin into the projectile.

13. The method of claim 12, wherein the fixing the firearm barrel to the test fixture includes clamping the firearm barrel between a first insert and a second insert, and clamping the first insert, the second insert, and the firearm barrel between an insert holder and a base of the test fixture.

14. The method of claim 12, wherein the supplying power to the actuation assembly includes remotely pressing a button to complete a circuit between a power supply and the actuation assembly.

15. A method of testing firearms or ammunition, the method comprising:

fixing a firearm barrel to a test fixture;

loading a projectile into the firearm barrel;

supplying power to an actuation assembly on the test fixture to activate a magnet; and pushing a firing pin in the test fixture into the projectile, wherein loading the projectile into the firearm barrel includes rotating a door of the test fixture to an open position, exposing a rear-facing end of the firearm barrel, loading a projectile into the rear-facing end of the firearm barrel, and rotating a door of the test fixture to a closed position, aligning the firing pin with the projectile.

16. The method of claim 15, further comprising loading the firing pin into the door of the test fixture.

17. The method of claim 16, wherein the loading of the firing pin into the door of the test fixture includes loading a rear support into a bore in the door, loading the firing pin into the rear support, and loading a front support onto the firing pin and into the bore in the door.

* * * * *